United States Patent [19]

Nielsen et al.

[11] 4,205,754

[45] Jun. 3, 1980

[54] CONTAINER CLOSURE AND A METHOD OF MAKING THE SAME

[75] Inventors: Ole S. M. Nielsen, Holte; Ejvind T. Jarsskov, Copenhagen, both of Denmark

[73] Assignee: Oniba I/S, Holte, Denmark

[21] Appl. No.: 904,308

[22] Filed: May 9, 1978

[30] Foreign Application Priority Data

May 9, 1977 [DK] Denmark ..... 2020/77
Mar. 3, 1978 [DK] Denmark ..... 985/78

[51] Int. Cl.[2] ..... B65D 51/18

[52] U.S. Cl. ..... 215/249; 113/121 A; 215/251; 215/364; 215/DIG. 3

[58] Field of Search ..... 215/247, 248, 249, 251, 215/258, 273, 274, 323, 324, 346, 350, 351, 364, DIG. 3

[56] References Cited

U.S. PATENT DOCUMENTS

| | | | |
|---|---|---|---|
| 3,071,274 | 1/1963 | Ravin | 215/249 |
| 3,088,615 | 5/1963 | Mumford et al. | 215/249 |
| 3,193,128 | 7/1965 | Ravin | 215/249 X |
| 3,547,297 | 12/1970 | Herbert et al. | 215/249 |
| 3,587,897 | 6/1971 | Rohde | 215/249 |

*Primary Examiner*—Stephen Marcus
*Attorney, Agent, or Firm*—Fleit & Jacobson

[57] ABSTRACT

A closure, preferably for pharmaceutical containers or bottles, and composed by a metal cap member with a central opening and a depending skirt, and a cover member closing the central opening of the cap member and sealingly engaging with the inner rim portion thereof. According to the invention the inner rim portion of the cap member is inclined inwardly at an acute angle, and when the cover member is later removed the rim portion is deformed or bent outwardly. The inner rim portion of the cap member is preferably bent to its inclined position when the cover member is mounted in the central opening of the cap member.

11 Claims, 11 Drawing Figures

CONTAINER CLOSURE AND A METHOD OF MAKING THE SAME

BACKGROUND OF THE INVENTION

1. Field of the Invention

The present invention relates to a closure for closing a neck opening of a container and of the type comprising a cap member having a flat annular top wall with a central opening and a skirt depending from the outer periphery of the top wall, and a cover member overlying the central opening of the cap member and including a connecting portion sealingly engaging with the inner edge of the cap member.

Closures of that type may in principle be used in connection with bottles or containers of any type. Up till now, however, they have normally been used in connection with ampoules or bottles containing a pharmaceutical liquid. The closure is then used partly for retaining a perforatable stopper or disc in the neck opening of the container or bottle, and partly for maintaining the outer surface of the perforatable stopper or disc in a sterile condition till the content of the bottle or container is to be used. At that time the cover member may be removed or torn from the cap member which is fastened to the neck of the bottle or container, whereby part of the perforatable disc or stopper is laid open.

2. Description of the Prior Art

The prior art comprises two fundamentally different closures of the above type. Thus, U.S. Pat. No. 3,193,128 discloses a closure in which the connection between the inner rim portion of the cap member and the removable cover member is of such a type that when the cover member is removed from the cap member, the cover member is torn along the inner edge of the cap member so that a peripheral part of the cover member clamped between the inner edge of the cap member and the perforatable stopper or disc arranged in said neck opening of the container, remains on the container or bottle. German "Offenlegungsschrift" No. 20 40 937 discloses a closure of the other type in which the inner rim portion of the cap member is connected to the cover member in such a manner that the cover member may be removed from the container in its entirety.

In the last mentioned of these known closure types the annular top wall or end wall of the cap member is substantially plane, and the inner rim portion of the annular top wall is sealingly received in an annular channel formed in the adjacent part of the cover member. Bottles or containers provided with closures of the type in question often have to be treated in an autoclave, and in that case the closure is influenced by a substantial overpressure generated within the container or bottle. This overpressure causes the top wall or end wall of the closure to bulge outwardly. In closures of the last mentioned known type in which the annular top wall of the cap member is substantially plane such outward bulge tends to increase the diameter of the central opening in the cap member and to decrease the diameter of the bottom wall of the annular channel formed in the cover member. Consequently, treatment in an autoclave may cause a leakage of the connection between the inner rim portion of the cap member and the cover member so that the perforatable stopper or disc is unintentionally contaminated prior to removal of the protecting cover member. It may even happen that the cover member is completely or partly pushed off during or in connection with processing of the containers in or removal of the containers from an autoclave. The fact that the cap member and the cover member are normally made from different materials having different coefficients of expansion, such as metal and plastic or rubber, respectively, increases the risk of leakage in connection with the described known closure.

SUMMARY OF THE INVENTION

The closure according to the invention is of the type in which the cover member may be removed in its entirety, and the invention provides an improved closure of the above type substantially reducing the risk that leakage occurs at the connection between the inner rim portion of the cap member and the removable cover member during processing in an autoclave or another heat treatment of a bottle or container on which the closure is mounted.

The present invention provides a closure for closing a neck opening of a container and comprising (a) a cap member including a substantially flat annular top wall having a central opening, a skirt depending from the outer periphery of said top wall, a deformable annular rim portion extending from the inner periphery of the top wall in the same general direction as said skirt and toward the longitudinal axis of the cap member so as to define an acute angle with said axis, said rim portion having a free edge defining said central opening, and (b) a cover member overlying said central opening and including an annular connecting portion sealingly engaging with said free edge of the rim portion which is deformable to such a degree that said cover member may be released from said cap member and removed therefrom in its entirety by a manually exerted force.

When the closure according to the invention is mounted on a container or bottle in which overpressure is generated due to processing in an autoclave or another heat treatment, this overpressure will tend to bend the inwardly extending inner rim portion of the cap member outwardly whereby the diameter of the inner edge of the rim portion will be decreased. Consequently, a possible overpressure in the container tends to press the inner edge of the cap member and the cover member into an even more tight mutual engagement. When the cover member is manually gripped and torn off the inner rim portion of the cap member may be bent further outwardly, and after removal of the cover member the rim portion may possibly be substantially plane or even outwardly bent. The manual force necessary for tearing off the cover member may be controlled, for example by changing the wall thickness of the inner rim portion of the cap member, the radial width of said rim portion, and/or the inclination of the rim portion with respect to the longitudinal axis of the closure.

The inner rim portion of the cap member preferably defines an angle of 45°–70° with said longitudinal axis. If the angle is less than 45° it will normally be too difficult to bend the rim portion of the cap member outwardly when the cover member is removed, and therefore the force required for removing the cover member may become too big. If the angle exceeds 70° the diameter decrease of the central opening obtainable by backward bending of the rim portion of the cap member is normally not sufficient for securing a tight engagement between the rim portion and the part of the cover member cooperating therewith. The inner rim portion of the cap member preferably forms an angle of 55°-60° with said longitudinal axis.

Viewed in a longitudinal section the rim portion of the cap member may be straight or have a curved shape. Furthermore, the transition between the inclined inner rim portion of the cap member and of the adjacent annular flat top wall may be a relatively sharp or a more or less rounded bend. When the inner rim portion of the cap member is bent outwardly either due to an overpressure in a container on which the closure is mounted or due to manual removal of the cover member the rim portion may be bent substantially uniformly along its radial width. The rim portion of the cap member may, however, be defined by an annular bending line substantially concentric with the inner edge of the rim portion and bending of the rim portion may then be concentrated along that bending line. Thus, such bending line may be a kind of "hinge" of the inner rim portion of the cap member and may, for example, be made by reducing the wall thickness of the cap member along that bending line. Such bending line gives a further possibility of controlling the force necessary for removing the cover member.

The closure according to the invention may be made in a manner known per se by positioning a separately made metal cap member in an injection moulding machine in which a cover member of plastic is injection moulded in situ in such a manner that the inner rim portion of the metal cap member is embedded in an annular bead formed on the inner side of the cover member. However, according to another concept the present invention provides a method of making a closure of the type described above from a cover member having a stopper-like projection, and a cap member including a substantially flat annular top wall having a central opening and a skirt depending from the outer periphery of the top wall, said method comprising inserting said stopper-like projection of the cover member into said central opening of the cap member and simultaneously bending the inner rim portion of said flat top wall in the direction of inserting said stopper-like projection so as to provide a rim portion defining an acute angle with the longitudinal axis of the cap member, and tightly engaging said rim portion with said stopper-like projection. Thus, the invention provides a simplified method in which bending of the rim portion of the cap member is performed simultaneously with mounting of the cover member on the cap member.

The tight engagement between the cap member and the cover member may be improved by heating material of said stopper-like projection and shaping the same so as to embed said rim portion therein. Softening of the material may be made in a manner known per se by suitable heating means or by means of ultra-sound.

When the rim portion of the cap member is embedded in the stopper-like projection of the cover member, the outer diameter of the stopper-like projection is normally chosen so as to be equal to or a little less than the diameter of the central opening in the cap member. Alternatively, the stopper-like projection may have a maximum diameter exceeding the diameter of the central opening, and in that case the necessary seal between the inner rim portion of the cap member and the stopper-like projection of the cover member may possibly be obtained without softening the material of the stopper-like projection. Thus, for example, the stopper-like projection may have an annular abutment or shoulder formed thereon for engaging with the inner edge of the rim portion of the cap member.

It may be desired to obtain an improved interlocking of the cap member and the cover member mounted thereon, for example in order to obtain an increased security that the closure may resist the forces to which it is exposed during heat treatment of a container or bottle provided with the closure. According to the invention this may be obtained by deforming part of the skirt of said cap member radially outwardly into a depression or depressions formed in the inner wall of a skirt portion of the cover member mounted on said cap member. The depression or depressions in the cover member may have any suitable form. For example the depressions may have the form of dots distributed over the periphery of the cover member skirt, or as one or more annular depressions extending along the periphery of the skirt. The depression or depressions may, however, preferably have a screw thread-like shape. In addition to interlocking the cover member and the cap member such depressions may serve to facilitate removal of the cover member when the cover member is turned in relation to the cap member. By using one or more threadlike depressions having a varying pitch the force necessary for removing the cover member may be increased whereby it will be more difficult for children to open the closure.

BRIEF DESCRIPTION OF THE DRAWINGS

The invention will now be further described with reference to the drawings, wherein.

DESCRIPTION OF THE PREFERRED EMBODIMENTS

Figure 3:
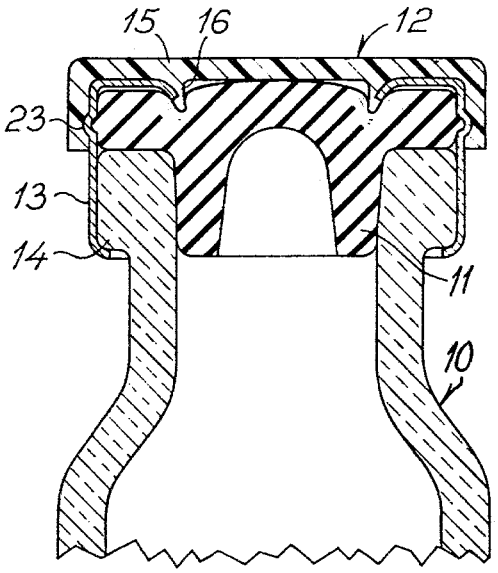
FIG. 3 is an axial sectional view of a container neck provided with a first embodiment of the closure according to the invention.
Figure 4:
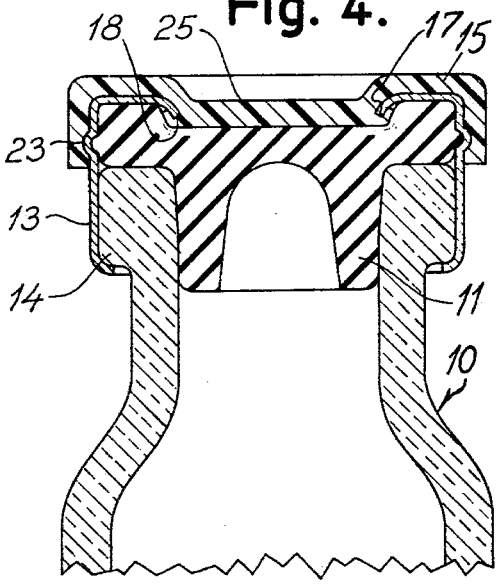
FIG. 4 is an axial sectional view of a container neck provided with a second embodiment of the closure according to the invention.
Figure 10:
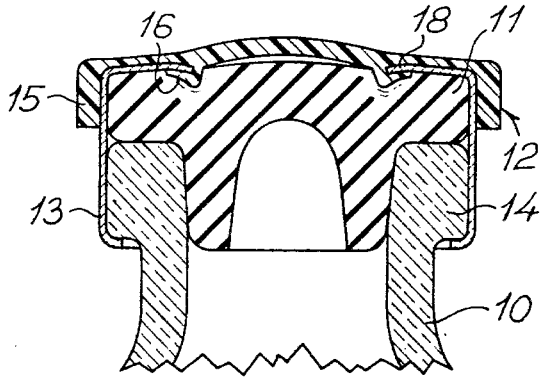
FIG. 10 is an axial sectional view of the bottle neck shown in FIG. 9 when the closure has been mounted thereon and the bottle has been exposed to a heat treatment in an autoclave.

FIGS. 3, 4 and 10 show a bottle-shaped container 10 which may, for example, contain a pharmaceutical or medical liquid in a sterile condition. The neck opening of the container is closed by means of a stopper 11 of rubber, soft plastic or a similar elastic and perforatable material. A closure generally designated by 12 surrounds the stopper 11 and retains it on the container 10. The closure 12 comprises an annular cap member 13 which is preferably made of metal, such as aluminum, and has a skirt the lower end portion of which is bent inwardly so as to engage with the bottom surface of an outer bead 14 formed on the container neck and so as to retain the closure on the container. The closure 12 also comprises a cover member 15 which may be made from plastic, rubber, or a similar material.

In the embodiments shown in FIGS. 3 and 10 the cover member 15 is provided with an annular projection 16 extending from the bottom surface thereof. When the cover member 15 is mounted on the cap member 13 the inner rim portion 18 of the cap member is tightly engaged by the projection 16 as shown in FIGS. 2, 3, 8 and 10. The rim portion 18 is inclined inwardly and extends in a direction defining an acute angle with the longitudinal axis 18*a* of the closure. Prior to mounting the closure 12 on the container 10 the rim portion 18 may preferably form an angle of 20°–45° and preferably 30°–35° with the flat top wall or end wall of the cap member, i.e. an angle of 45°–70° and preferably 55°–60° with the axis 18*a* of the closure. When the closure 12 is mounted on the container 10 the annular projection 16 is pressed against the elastic stopper 11 as shown in FIGS. 3 and 10 so as to form an annular seal.

Figure 1:
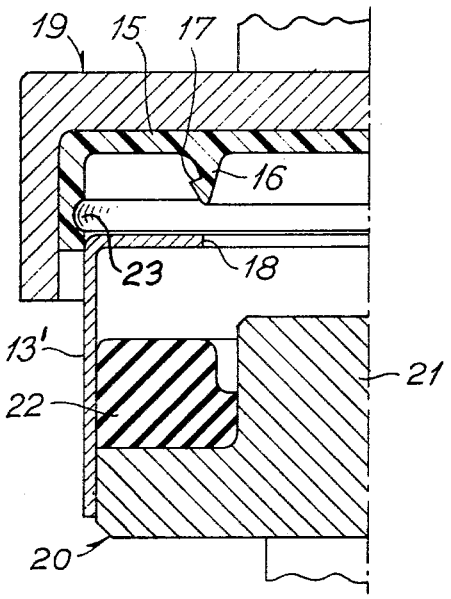
FIG. 1 is part of an axial sectional view illustrating the initial step of a mounting operation by which the parts forming the closure according to the invention may be mounted.
Figure 2:
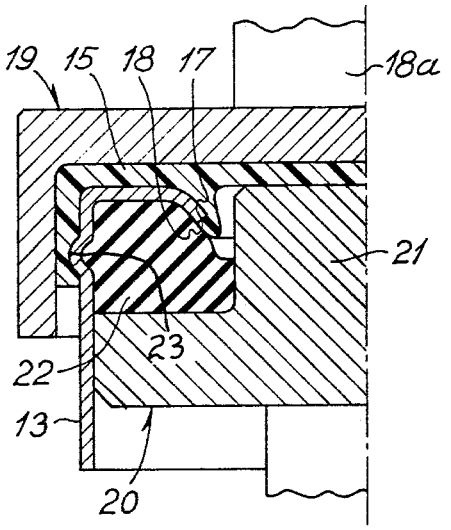
FIG. 2 is part of an axial sectional view corresponding to that shown in FIG. 1, but illustrating another step of the mounting operation.

In the embodiment shown in FIGS. 1–3 an annular abutment or shoulder 17 (FIG. 1) is formed on the outer peripheral surface of the annular projection 16 of the cover member 15. The cap member 13 and the cover member 15 may then be made separately and the cover member 15 may thereafter be mounted on the annular metal cap member 13 so as to close the central opening thereof. This mounting operation may, for example as illustrated in FIGS. 1 and 2, be performed by positioning the cover member 15 and the cap member 13 in a female element 19 and on a piston-like male element 20 of a mounting tool, respectively. The male element 20 consists of a metal part having a stop projection 21 and a ring 22 of rubber or a similar elastic material surrounding said projection. When the metal cap member 13 is positioned on the male member 20 it may have the shape shown in FIG. 2 with a bent inner rim portion. The cap member is, however, preferably formed as a blank 13' which as shown in FIG. 1 has a cross-sectional shape defining a right angle.

When the male member 20 and the blank 13' arranged thereon is pushed into the female member 19 the rubber ring 22, which is oversized to a certain degree, is compressed whereby the annular projection 16 of the cover member 15 will be pessed radially inwardly as indicated in FIG. 2. Simultaneously the compressed material in the rubber ring 22 tends to shape the blank 13' so that it is caused to tightly engage the adjacent inner surface parts of the cover member 15 as shown in FIG. 2.

Figure 5:
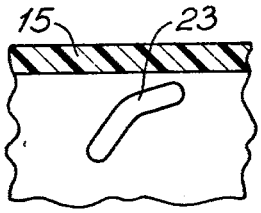
FIG. 5 is a fragmentary view in an enlarged scale showing the inner wall of the skirt of a plastic cover member forming part of the closure.
Figure 6:
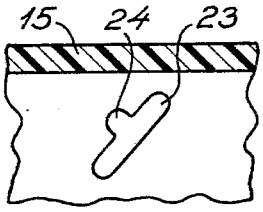
FIG. 6 is the same as FIG. 5, but shows a modified embodiment.

In order to provide a possibility of obtaining a good interlocking of the metal cap member 13 and the cover member 15 in addition to that obtained by the engagement between the inner rim portion 18 of the cap member and the shoulder 17, one or more depressions 23 may be formed in the inner surface of the skirt of the cover member 15. These depressions may have any suitable form, for example like a screw thread. FIGS. 5 and 6 show examples of such screw thread-like forms.

When the cover member 15 is provided with such depressions and a male element of the type described above including a compressible material is used, the skirt of the metal cap member 13 may be deformed radially into the depressions 23 during the mounting operation, whereby the skirts of the cover member 15 and of the cap member 13, respectively, are interlocked against relative axial movement. When the closure 12 has been mounted on the container 10 and the cover member 15 is later to be removed, the initial step of removal may be taken by turning the cover member 15 in relation to the cap member 13 provided that the depressions 23 have the proposed screw thread-like shape. If the screw thread-like depressions 23 have a varying pitch as shown in FIG. 5 or are provided with an enlargement 24 as shown in FIG. 6 a relatively high torque must be applied to the cover member 15 in oder to obtain an axial displacement of that member in relation to the cap member 13. The shape of the depressions 23 may be adapted so that in order to remove the cover member 15 it is necessary to manually apply a torque thereto which cannot be provided by smaller children. This is especially important when the closure is used in connection with bottles or other containers containing a product, for example a medicine which may be dangerous for children.

FIG. 4 shows a closure 12 wherein the cover member 15 and the stopper 11 have been modified. A central portion 25 of the top wall or end wall of the cover member 15 is offset inwardly into the cap member 13, and a corresponding recess is formed in the stopper 11. The abutment or shoulder 17 cooperating with the inner edge of the metal cap member 13 is shaped on the outer peripheral surface of that central portion 25. In order to obtain an improved interlocking of the cover member 15 and the cap member 13 material in the cover member adjacent to the shoulder 17 may be softened in connection with or after the mounting operation and deformed so as to embed the rim portion 18 of the cap member 13 therein as shown in FIG. 4. Softening of the cover member material may, for example, be obtained by means of heat or ultra-sound.

Bottles of the type shown in FIGS. 3 and 4 are normally subjected to a heat treatment in an autoclave when the closure 12 has been mounted thereon. By that heat treatment an overpressure is generated in the bottle 10 causing the top wall of the cover member to bulge outwardly. Such overpressure will, however, cause that the abutment or shoulder 17 is pressed even tighter against the inner edge of the cap member 13 so that the forces applied to the cover member 15 during heat treatment do not cause any leakage. The risk of leakage at the connection between the parts of the closure 12 during heat treatment may be further reduced by the interlocking obtained by the engagement of the metal cap member 13 into the depressions 23 of the inner skirt wall of the cover member 15 as described above.

The closure 12 prevents contamination of the outer surface of the stopper 11 during storage. However, when the content of the container 10 is to be used the cover member 15 has to be removed. If the cover member is provided with screw thread-like depressions 23 removal of the cover member is initiated by turning the cover member 15 in relation to the metal cap member 13 as described previously, whereby the skirt of the cover member 15 is displaced axially outwardly and simulaneously deformed radially outwardly. The skirt of the cover member 15 may now be gripped manually and the cover member may easily be pulled or pushed out of engagement with the inner peripheral edge of the metal cap member 13.

It should be understood that the technique of using a compressible piston—which in the present case is the rubber ring 22—in order to deform a wall part into an adjacent depression cannot only be used in connection with the manufacture of closures of the present type, but also within certain other fields.

Figure 7:
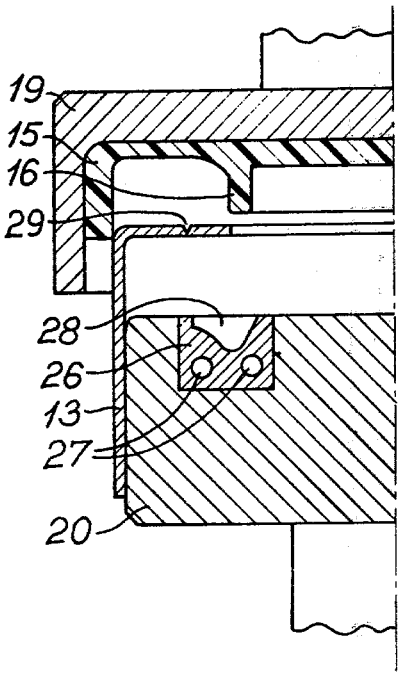
FIGS. 7 and 8 illustrate different steps of a method for mounting the cover member on the cap member for forming a third embodiment of the closure according to the invention.
Figure 8:
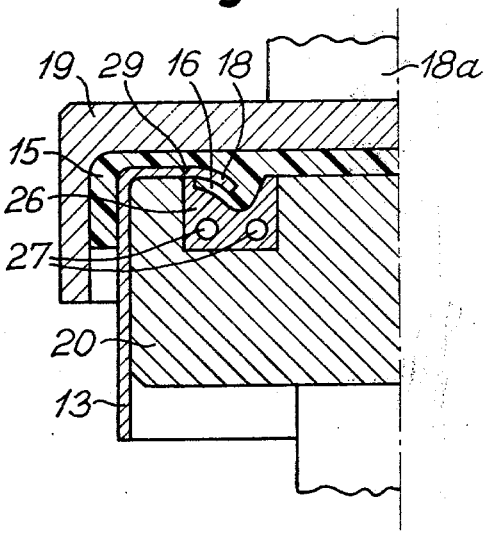

The embodiment shown in FIG. 10 may be produced by injection moulding the cover member 15 in situ on the cap member 13. However, the cap member and the cover member are preferably made separately, and the cover member 15 is then later mounted on the cap member 13 so that it closes the central opening of the cap member. As illustrated in FIGS. 7 and 8 the cover member 15 may be arranged within the female element 19 and the annular cap member 13 may be arranged on the male element 20 of a modified mounting tool. The end surface of the male member 20 defines an annular channel receiving a heating body 26 which may contain passages 27 for a heating medium as shown. The body 26 may, however, also be electrically heated. The heating body 26 may, alternatively, be replaced by a body (not shown) for generating ultrasound. An annular recess 28 is formed in the body 26 As shown in FIG. 7, the annular projection 16 of the cover member 15 originally has a cylindrical shape with an outer diameter which substantially corresponds to the diameter of the central opening of the cap member 13. When the female element 19 and the male element 20 are pressed into engagement with each other the skirt of the cover member 15 is pushed around the cap member 13 and the projection 16 is simultaneously moved into the central opening of the cap member. The recess 28 in the heating body has such a shape that the annular projection 16 being softened by the heating body is caused to tightly surround the inner rim portion 18 of the cap member as shown in FIG. 8. This rim portion 18, which is initially in a substantially plane condition as shown in FIG. 7, is simultaneously bent to a downwardly inclining position so as to define an acute angle as stated above.

Figure 9:
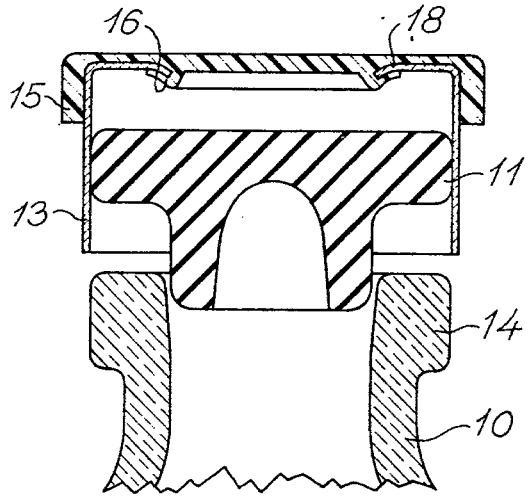
FIG. 9 is an axial sectional view of a bottle neck and a closure as that shown in FIGS. 7 and 8 being about to be mounted on the neck.
Figure 11:
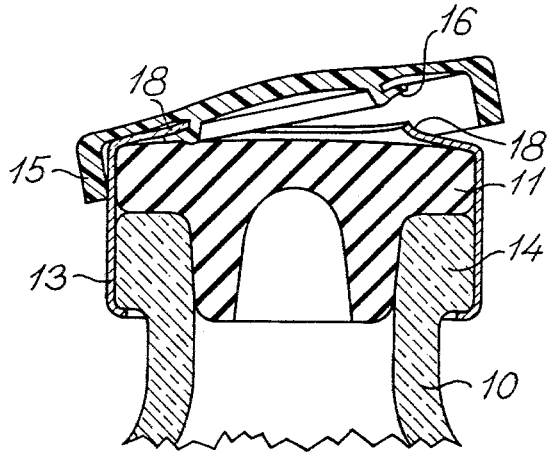
FIG. 11 is an axial sectional view of the bottle neck shown in FIG. 10 where the cover member of the closure has been partly removed.

As shown in FIG. 9 the closure thus assembled may be mounted on the container 10 so that it surrounds and retains the stopper 11. If the container 10 is subjected to a heat treatment in an autoclave an overpressure is generated in the container or bottle 10 as explained above causing the cover member to bulge outwardly. As illustrated in FIG. 10 such bulging causes that the inner rim portion 18 of the cap member is bent more or less outwardly towards its plane condition. Such outwardly bending of the rim portion will, however, decrease the diameter of the central opening of the cap member 13 and thereby press the rim portion 18 even tighter against the bottom of the annular channel formed in the projection 16 and receiving the rim portion 18. This fact substantially reduces the risk of leakage at the connection between the rim portion 18 and the projection 16. Thus, the closure 12 will effectively prevent contamination of the outer surface of the stopper 11 after heat treatment in an autoclave. When the content of the container 10 is to be used the cover member 15 may be removed by applying a manual pressure at the lower edge of the skirt of the cover member 15. The inner rim portion 18 of the cap member will then be brought out of engagement with the channel in the projection 16 of the cover member 15, the rim portion 18 being normally bent somewhat upwardly as illustrated in FIG. 11.

The cover member 15 should not be so easily removable that it may be loosened or removed unintentionally. On the other hand, a normal grown up person should be able to remove the cover member without great difficulty by applying a finger pressure thereto. Therefore, it is desirable to be able to accurately control the force necessary for removing the cover member. In the embodiment described such force is dependent on the force which is necessary for bending the inclined inner rim portion of the cap member 13 outwardly, and consequently on the wall thickness and the inclination of the rim portion 18. It is understood that control of the force necessary for removing the cover member 15 is possible to a higher extent in the closure according to the invention than in known closures. Furthermore, as indicated in FIGS. 7 and 8 it is possible to limit the rim portion 18 by means of a weakening line or bending line 29 concentric with the central opening of the cap member 13 and forming a kind of "hinge" of the rim portion 18.

EXAMPLE

A closure of the type shown in FIG. 9 may, for example, be made from a cover member 15 of polyethylene and a cap member 13 made by drawing of an aluminum sheet. The parts 13 and 15 may be shaped substantially as shown in FIG. 7, but without the bending line 29. The cap member 13 may then, for example, have a wall thickness of 0.3 mm, an outer diameter of 33 mm, and prior to bending the inner rim portion 18 inwardly the central opening may have a diameter of 20 mm. The annular projection 16 of the cover member 15 may have an outer diameter of 19.7 mm and an inner diameter of 19 mm. When the cap member and cover member is assembled to a closure in the manner illustrated in FIGS. 7 and 8 the inner rim portion 18 having a radial width of about 1.9 mm is bent inwardly so as to define an angle of about 30°–35° with its normal plane position, and the polyethylene material in the projection 16 is softened by heating and deformed so that the rim portion becomes ebedded therein. Thereby a closure having the desired characteristics described above is obtained.

We claim:

1. A closure for closing a neck opening of a container and comprising:

(a) a cap member including a substantially flat annular top wall having a central opening, a skirt depending from the outer periphery of said top wall, a deformable annular rim portion extending from the inner periphery of the top wall in the same general direction as said skirt and toward the longitudinal axis of the cap member so as to define an acute angle with said axis, said rim portion having a free edge defining said central opening, and (b) a cover member overlying said central opening and including an annular connecting portion sealingly engaging with said free edge of the rim portion, said connecting portion being deformable to such a degree that said cover member is releasable from said cap member and removable therefrom in its entirety by a manually exerted force.

2. A closure according to claim 1, wherein said rim portion defines an angle of 45°–70° with said longitudinal axis.

3. A closure according to claim 2, wherein said rim portion forms an angle of 55°-60° with said longitudinal axis.

4. A closure according to claim 2, wherein aid rim portion is defined between said free edge and a circular bending line substantially concentric with said free edge.

5. A closure according to claim 4, wherein said cap member has a reduced wall thickness along said bending line.

6. A closure according to claim 1, wherein said free edge of the rim portion is biassed towards an annular shoulder formed on said cover member, said cover member being of an elastic material.

7. A closure according to claim 1, wherein said cover member is made from plastic and said cap member being made from sheet metal.

8. A closure according to claim 7, wherein said sheet metal is aluminum.

9. A closure according to claim 1, wherein said connecting portion of said cover member is softened and has embedded therein said free edge of said rim portion of said cap member.

10. A closure according to claim 1, wherein said cover member includes a downwardly-extending peripheral portion at least partially encompassing said skirt of said cap member, said encompassed portion of said skirt and said peripheral portion including complementary locking means for interlocking said cover member and said cap member against relative axial movement.

11. A closure according to claim 10, wherein said complementary locking means comprises at least one depression formed in said peripheral portion of said cover member and at least one protruding portion formed in said cap member and extending into said depression.

* * * * *